US006655268B2

(12) United States Patent
Comley et al.

(10) Patent No.: US 6,655,268 B2
(45) Date of Patent: Dec. 2, 2003

(54) COMPACT HOT PRESS

(75) Inventors: Peter N. Comley, Sumner, WA (US); Robert C. Larsen, Bonney Lake, WA (US); Alan T. Potter, Fife, WA (US); Noel A. Spishak, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 42 days.

(21) Appl. No.: 10/001,906

(22) Filed: Oct. 31, 2001

(65) Prior Publication Data

US 2003/0079619 A1 May 1, 2003

(51) Int. Cl.[7] ..... B02C 11/08

(52) U.S. Cl. ..... 100/319; 100/326; 100/321

(58) Field of Search ..... 100/323, 326, 100/325, 324, 321, 319, 317, 339, 218, 194, 195, 196, 269.01, 342, 348, 918

(56) References Cited

U.S. PATENT DOCUMENTS

| | | | | |
|---|---|---|---|---|
| 3,533,352 A | * | 10/1970 | Miller | 100/325 |
| 3,754,499 A | * | 8/1973 | Heisman et al. | 100/323 |
| 4,162,869 A | | 7/1979 | Hitomi et al. | |
| 4,795,125 A | * | 1/1989 | Boros et al. | 249/78 |
| 5,069,120 A | * | 12/1991 | Schneider | 100/323 |
| 5,156,087 A | | 10/1992 | Cusson et al. | |
| 5,297,480 A | * | 3/1994 | Miyashita et al. | 100/90 |
| 5,558,015 A | | 9/1996 | Miyashita et al. | |
| 5,578,159 A | | 11/1996 | Miyashit et al. | |
| 5,749,696 A | | 5/1998 | Johnson | |
| 5,788,909 A | * | 8/1998 | Kreutzer et al. | 264/320 |
| 6,047,634 A | * | 4/2000 | Futsuhara et al. | 100/43 |

FOREIGN PATENT DOCUMENTS

| | | |
|---|---|---|
| EP | 0 753 396 A2 | 1/1997 |
| WO | WO 96/40466 | 12/1996 |

* cited by examiner

*Primary Examiner*—Allen Ostrager
*Assistant Examiner*—Shelley Self
(74) *Attorney, Agent, or Firm*—Black Lowe & Graham PLLC

(57) ABSTRACT

The present invention is a portable, compact hot press. The hot press includes a frame that has a press unit attached thereto. The press unit has a crown plate, a bolster plate, and a base plate. An upper press unit is attached to the crown plate and a lower press unit is attached to the bolster plate. The lower press unit is configured to contact the upper press unit when the press is in a closed position. The press further includes a control unit attached to the frame. The control unit is configured to manually or automatically control press operation. Additionally, the press includes a hydraulic unit that is attached to the frame and is configured to facilitate motion of the press operation.

14 Claims, 6 Drawing Sheets

COMPACT HOT PRESS

FIELD OF THE INVENTION

This invention relates generally to hot presses and, more particularly to, single unit portable hot presses.

BACKGROUND OF THE INVENTION

Many processes are known in the art for forming metallic parts. These processes include, among others, milling, stamping and pressing. The use of a hot press to form metallic parts is often preferred over other forming processes. However, current hot press designs and their resulting forming processes are relatively inefficient. Additionally, current hot press technology poses safety hazards to press operators and press equipment.

Typical hot presses are large, multi-unit machines. Each machine includes a press unit, a control unit, and a hydraulic unit. Each unit is typically a stand-alone unit with minimal interconnection between the units. Consequently, each machine occupies a significant volume of shop space. Moreover, the volume of space typically occupied by each machine exceeds by orders of magnitude the size of part being produced. Additionally, to move the machine, each unit must be disconnected from the other units, moved separately, and subsequently re-connected. Thus, not only do current hot presses inefficiently utilize space, but they also require excessive time and effort to relocate.

Thermal inefficiencies are another drawback of current hot presses. The thermal inefficiencies are derived from several sources. Heated platens employed by the press typically are not adequately insulated and only heat a single surface of the die. Also, the lack of insulation surrounding the platens results in excessive heat loss, which requires additional energy to achieve and maintain die temperature. The single heating point design requires additional time to achieve a desired thermal equilibrium throughout the die. Additionally, current hot presses include large access doors that must be opened to insert or remove the parts to be formed. The large doors allow a massive amount of heat loss every time they are opened. This problem is compounded because these same presses lack structure to align the die within the press during die loading, the doors must remain open for an excessive length of time during the part and die loading process. Consequently, considerable time is spent, and thus heat energy lost, while manually positioning the part and die in the press.

Current hot press designs create a number of safety hazards. The lack of adequate insulation surrounding the heating platens results in a considerable amount of convective heat being radiated. Consequently, an operator is required to wear a great deal of thermally-resistive safety clothing and equipment. This safety equipment is generally uncomfortable and cumbersome to wear. Further, the cumbersome nature of the equipment potentially creates additional hazards by inhibiting the operator's movement.

Standard hot presses employ a downward directed press motion that creates another safety hazard. The downward directed press movement requires elements of the hydraulic unit to be above the heated platens. Thus, any leaking of hydraulic fluid from the hydraulic unit can contact the heated platens creating a fire hazard.

Thus, there is an inert need in the art for a hot press that efficiently uses space, is thorough, efficient, and overcomes safety hazards posed by current hot presses known in the art.

SUMMARY OF THE INVENTION

The present invention is a hot press that efficiently uses space, is thermally efficient, and overcomes safety hazards associated with known hot presses.

The present invention is a portable, compact hot press. The hot press includes a frame that has a press unit attached thereto. The press unit has a crown plate, a bolster plate, and a base plate. An upper press unit is attached to the crown plate and a lower press unit is attached to the bolster plate. The lower press unit is configured to contact the upper press unit when the press is in a closed position. The press further includes a control unit attached to the frame. The control unit is configured to manually or automatically control press operation. Additionally, the press includes a hydraulic unit that is attached to the frame and is configured to facilitate motion of the press operation.

Another aspect of the present invention is a method of operating a compact hot press. A part is loaded into the press. The part is preheated to a predetermined temperature. After the press is preheated, the press is closed and the part is placed under load. The load is maintained for a predetermined time. At the expiration of the predetermined time, the press is opened and the part is removed.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
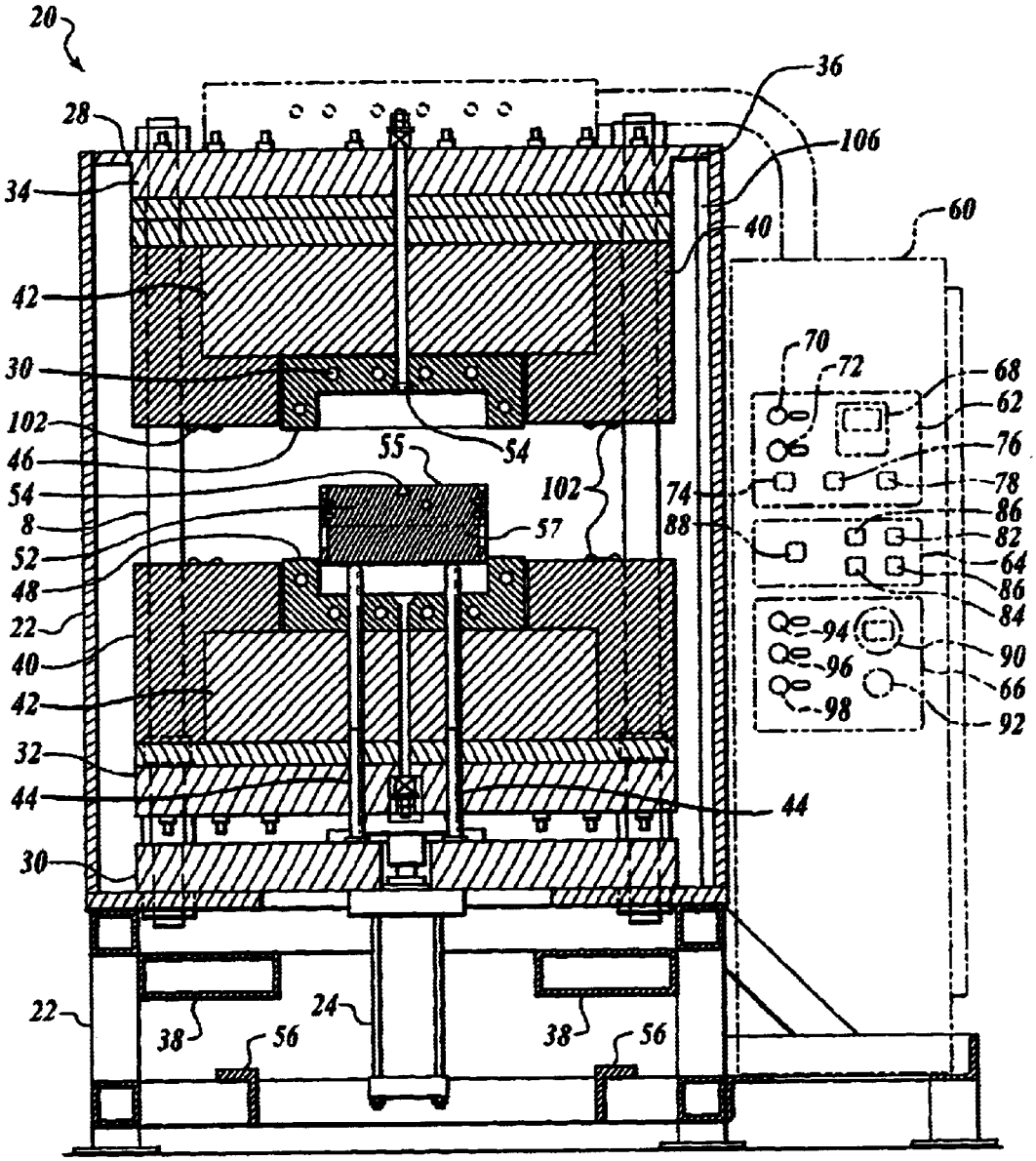
FIG. 1 is a front view of a hot press according to the invention.

The present invention provides a system and method for hot forming metallic parts. By way of overview and with reference to FIG. 1, one presently preferred embodiment of the present invention includes a hot press 20 including a press unit 28, control unit 60 and a hydraulic unit 26 (see FIG. 2). The press unit 28, control unit 60, and hydraulic unit 26 are supported by a single frame 22. The frame 22 includes a pair of lift sections 38 providing portability of the entire press 20 as a single unit via a forklift or similar machine. Specific details of the press 20 are described with more particularity below.

The press unit 28 is set in a four-post Danly die set with three plates 30, 32 and 34 and four columns 58. The press unit 28 generally includes a base plate 30 attached to a lower portion of the frame 22 and a crown plate 34 attached to an upper portion of the frame 22. Disposed between and mechanically connected to the base plate 30 and the crown plate 34 is a movable bolster plate 32. A hydraulic cylinder 24 of the hydraulic unit 26 (see FIG. 2), is up-acting and attached to the middle of the bolster plate 32, thereby vertically displacing the bolster plate 32 upwardly and downwardly during press 20 operation.

Attached to the crown plate 34 and the bolster plate 32 are upper and lower press units 36 and 37, respectively. The lower press unit 37, and the substantially similar upper press unit 36 each include non-load bearing insulation 40 that substantially surrounds a load bearing ceramic block 42. In one presently preferred embodiment, at least six inches of insulation surround the ceramic block 42 in each press unit, 36 and 37. However, it will be appreciated that any other insulation thickness is considered within the scope of this invention and may be used for a particular application. The arrangement of the insulation 40 and the ceramic blocks 42 is such that when an upper platen 46 is inserted into the upper press unit 36 or a lower platen 48 is inserted into the lower press unit 37, each platen 46 and 48 contacts the corresponding block 42 while simultaneously being substantially surrounded by the insulation 40. In this manner, the block 42 carries any loading resulting from operation of the press 20 while the insulation 40 prevents the platens 46 and 48 from experiencing excessive heat loss throughout the operating range of the press 20. Additionally, it should be noted that the block 42 is suitably constructed from a ceramic material and is therefore an insulating element.

The upper platen 46 and lower platen 48 are substantially similarly shaped elements designed to entirely surround a die 52 when the press 20 is in a closed position. Each platen 46 and 48 includes a plurality of heater bores 50 extending into the platen. Each heater bore 50 is designed to receive a heater 104 (see FIG. 2), discussed in more detail below.

Figure 2:
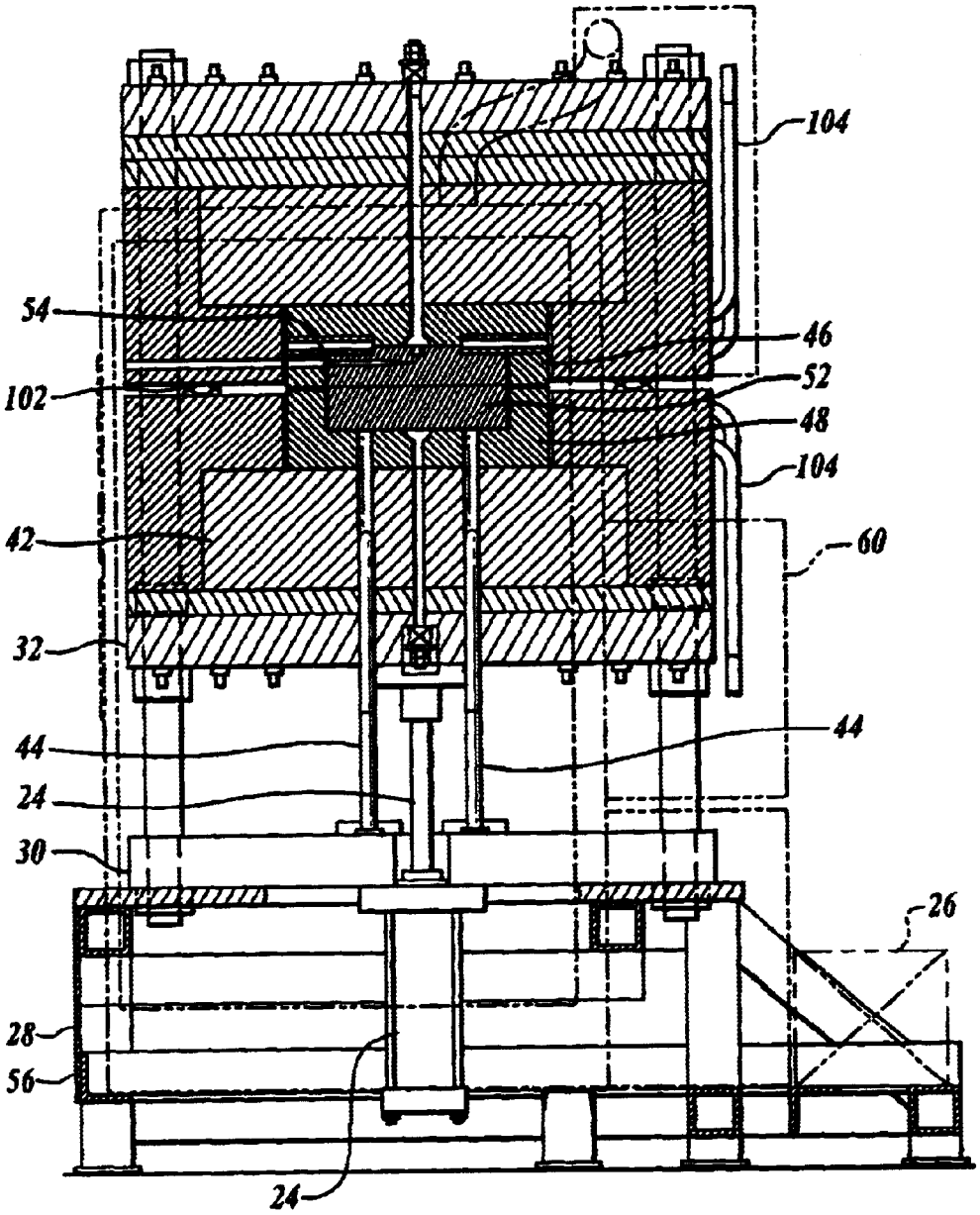
FIG. 2 is a side view of the hot press of FIG. 1.

Referring now to FIGS. 1 and 2, a part (not shown) being formed in the press 20 is located between an upper portion 55 and a lower portion 57 of the die 52. Thus, to remove or insert a part, the two portions 55 and 57 of the die 52 must be separated. To maintain production efficiency, the die 52 must be separated while the die 52 is at operational temperature. A die holding key 54 locks the upper portion 55 of the die 52 to the upper platen 46 thereby lifting the upper portion 55 when the press 20 is opened. The key 54 includes an elongated member extending through the upper press unit 36. The key 54 is I-shaped and somewhat resembles a "dog bone." The key 54 is easily inserted and removed by an operator by sliding the key 54 into and out of tube 59 and the upper press unit 36. Thus, optimal thermal efficiency is maintained as the die 52 is at temperature during a part change and each portion 55 and 57 of the die 52 is in constant contact with its respective heating platen 46 and 48. Consequently, cycle time for part formation is greatly reduced.

According to the present invention, the press 20 includes unique, passive die loading system. In a presently preferred embodiment, four pins 44 are mounted to the base plate 30. FIG. 1 depicts the press 20 in the die load and unload position. When the press 20 is in this position, or fully down, the pins protrude through the bolster plate 32, lower press unit 37, and lower platen 48 to contact the die 52. The pins 44 maintain the die 52 at an elevation above the lower press unit 37 thereby allowing a lift truck, discussed below, to remove the die 52. In this manner, a full die 52 change is shortened from a time that exceeds twenty minutes for currently known presses to a time that is less than five minutes.

Referring back to FIG. 1, in a presently preferred embodiment, the control unit 60 includes three main control sections: a process control 62, a heater control 64, and a ram control 66. The process control 62 includes a cycle timer 70 that keeps track of various cycle times. For example, preheat time and loading time, are discussed in more detail below. An emergency stop switch 72 is a safety feature of the press 20. The press 20 will not operate, or will stop operating, if the stop switch 72 is tripped. Also included in the process control 62 unit are an automatic cycle start switch 74 and a cycle stop 76 switch. The switches 74 and 76 provide a one-button cycle start/stop for the automated press 20. Finally, a tool temperature chart recorder 68 and recorder actuator 78 are coupled together to track and record temperature of the tool or part during operation of the press 20. The temperature chart recorder 68 is connected to thermcouples attached to the press units 36 and 37 and provides a written chart to record tool temperature throughout part forming operations.

The heater control 64 activates the heaters 104 used to heat the platens 46 and 48. The heater control 64 includes a heater power switch 88, which provides power to the heaters 104. Additionally, the heater control includes upper platen heater control 80 and a lower platen heater control 84, both of which are used to vary temperature in each respective platen 46 and 48. Finally, the heater control 64 includes separate alarm indicators for both the upper platen 46 and the lower platen 48. An upper platen alarm 82 and a lower platen alarm 86 notify the operator if either or both of the platens 46 and 48 are experiencing heating problems.

The ram control 66 includes manual controls for the press 20. A manual press open switch 94, a press close switch 96, and a die unload switches 98 are provided. The switches allow the operator to manually open and close the press 20, either fully or partially. Also, a load indicator 90 and a load adjust control 92 are provided to monitor and adjust the loading applied to the die 52.

An additional safety feature of the press 20 is a light curtain 106 covering the front and back of the press 20. The light curtain 106 projects a light beam, or curtain across a chosen portion of the press, such as the front or back of the press 20. If the beam is broken or interrupted, for example, by a hand or any other part of an operator's body, the press operation stops. In this fashion, the operator is protected from accidental injury from the press. Likewise, the press 20 is protected from damage by foreign bodies entering the range of motion of the press 20. Additionally, the sides of the press 20 are preferably covered with a suitable material, such as a wire mesh (not shown), to provide similar protection to the sides of the press 20.

FIG. 2 depicts a side view of a presently preferred embodiment of the hot press 20. The press 20 is viewed in a closed position. In this position, the die 52 is heated and is under load. The upper and lower platens 46 and 48 completely surround the die 52, thereby heating the die 52 from all sides. Bulb seals 102 mate to prevent heat loss between the upper and lower press units 36 and 37.

A plurality of quick-change heaters 104 are adjacent the rear portion of the press 20. Each heater 104 is a separate, electrically controlled unit designed to pass through small openings (not shown) in the back of the press units and into the heater bores 50 of the platen 46 and 48. In addition to providing heater access into the press 20, the openings also provide the operator instant visual verification whether each heater 104 is operating. More specifically, in one embodiment of the invention, when a heater 104 is operating at temperature, an orange glow can be seen surrounding the hot portion of the heater 104. To verify whether a heater is functioning properly the operator simply views axially down the opening and looks for the glow. This aspect of this invention provides practically instantaneous feedback regarding integrity of the heater 104. If one or more of the heaters 104 is not functioning properly, attaining a desired thermal equilibrium within the press 20 becomes more difficult to attain, thereby increasing process time and/or adversely affecting part integrity.

The position of each heater 104 is maintained within the press 20 by a simple bracket (not shown) attached to an outer portion of the press 20. Thus, to remove or insert each heater 104, the operator simply releases the heater 104 from the bracket and slides the heater 104 out of or into the press 20. The removal or insertion of the heater 104 does not require opening the press 20 or moving any insulation material. Thus, thermal integrity of the hot press 20 is not breached during change or inspection of a heater 104. Heaters 104 can be changed while the press is hot.

In one presently preferred embodiment, the heating system suitably includes six heaters 104 in each of the upper platen 46 and the lower platen 48 for a total of twelve heaters 104. The heaters 104 suitably operate on 120 volts AC electrical power. The heaters 104 suitably provide an output of 1.67 kW. Each heater 10 suitably measures 0.935-inch in diameter with a heated length of 21.5 inches. Thus, each heater produces 26.4 watts per square inch. However, it will be appreciated that any number of heaters 104 is considered within the scope of this invention. Likewise, the power requirements and geometric configuration of the heaters 104 are variable based upon press application 20 and are considered within the scope of this invention.

The location of the hydraulic unit 26 in a presently preferred embodiment of the instant invention is also depicted in FIG. 2. The hydraulic unit 26 is located in the bottom rear portion of the press 20. The location of the hydraulic unit 26 keeps all hydraulic fluids below all heated elements of the press, thereby preventing a fire. This location of the hydraulic unit 26 also prevents any unwanted fluid quenching of the formed part or die 54.

In a presently preferred embodiment, the hydraulic unit 26 is suitably capable of providing in excess of ten tons of load for proper part formation. A unique air/oil system using a one hundred psi air pump (not shown) over a hydraulic system is employed. Two air pumps (not shown) pump hydraulic fluid to a thirty-ton hydraulic cylinder 24. A five hundred psi low pressure pump (not shown) moves the bolster plate 32 up and down when the press 20 is not under load. A thirty-four hundred psi high pressure pump (not shown) provides the forming load. The hydraulic cylinder is preferably rated at thirty tons. It will be appreciated that air over oil pumps are well known in the art. As a result, a detailed explanation of construction and operation of the air over oil pumps discussed herein is not necessary for an understanding of the invention. Suitable air over oil pumps include SP5455 available from Sprague. It will be appreciated that other air pumps, air over oil hydraulic pumps, and hydraulic cylinders may be used as desired for a particular application.

Figure 3:
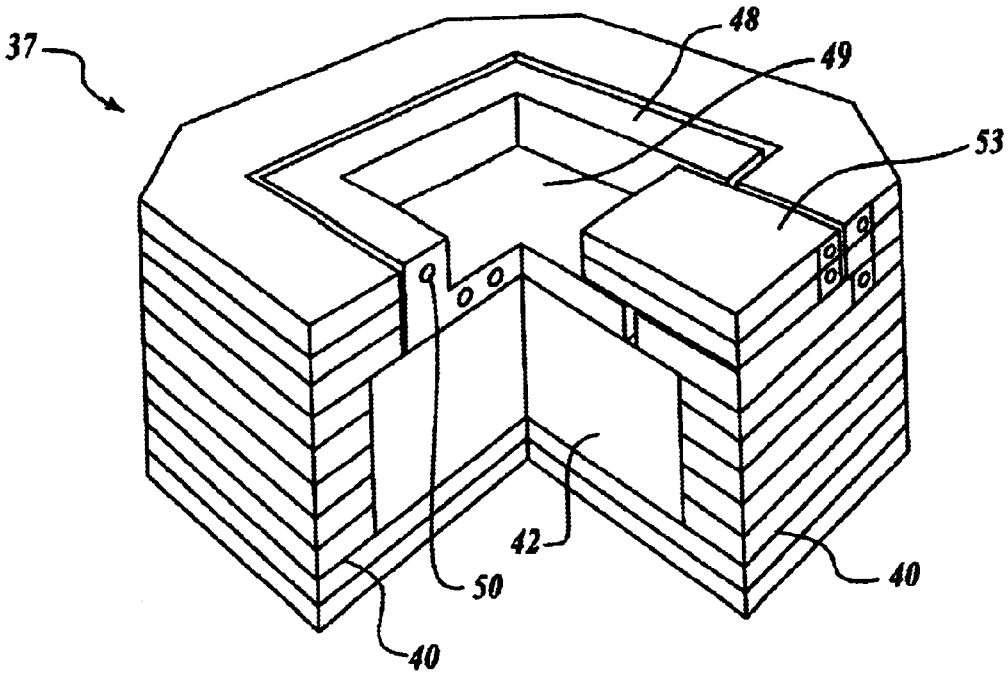
FIG. 3 is a sectional view of a press unit.

FIG. 3 depicts a more detailed view of lower press unit 37, including the insulation 40 and platen 48 arrangement. It is to be understood that the upper press unit 36 is substantially similar in design to the lower press unit 36. The insulation 40 surrounds the platen 48 to minimize heat transfer from the platen 48 to the surrounding environment. Additionally, surrounding the platens 46 and 48 with insulation improves safety by reducing the temperature around the press 20. For example, in one presently preferred embodiment, the platens 46 and 48 heat the die 52 (FIG. 1) to about 1300 degrees Fahrenheit. However, the insulation 40 surrounding the platen 46 keeps the outside of the press units 36 and 37 at approximately 140 degrees Fahrenheit. Consequently, the operators do not need to wear bulky heat resistant safety equipment.

Another advantage of the invention depicted in FIG. 3 is the geometry of the platens 46 and 48. The heater platens 46 and 48 form a cavity 49 in which the die 52 sits. When the platens 46 and 48 are brought together, the die 52 is completely surrounded. Thus, during the heating process, the die 52 is heated from all sides. This greatly reduces heating time and heat loss during operation. Additionally, the die cavity 49 automatically aligns the die 52 within the press thereby reducing cycle time to the die 52.

An insulated door 53 is also depicted in FIG. 3. In a presently preferred embodiment, the lower press unit 37 includes a pair of the insulated doors 53 located adjacent a top center surface of the lower press unit 37. However, other arrangements are considered within the scope of this invention. For example, a single door 53 or a no-door arrangement is considered within the scope of this invention. The doors 53, when closed, insulate the heated platens 46 and 48. When open, the doors 53 provide an access point to insert and remove the die 52.

Figure 4:
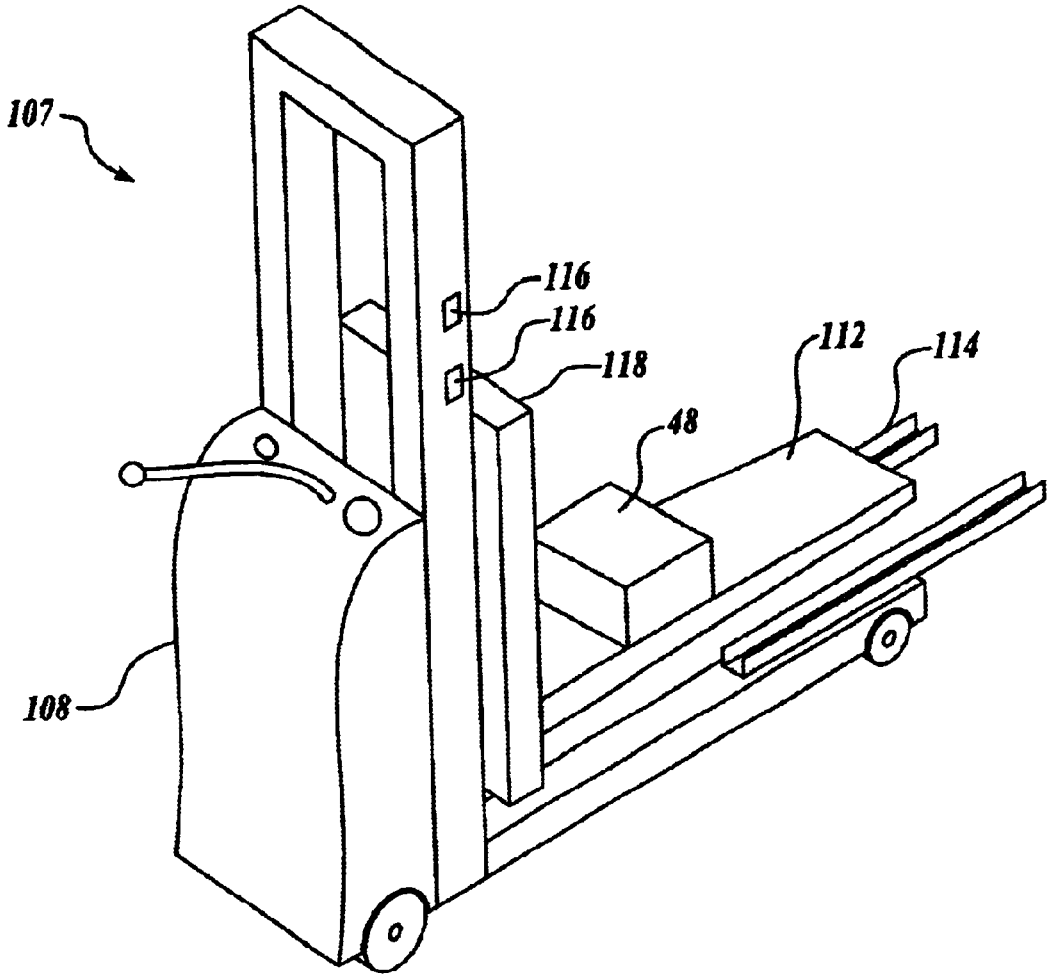
FIG. 4 is an isometric view of a lift truck.

FIG. 4 depicts a lift truck 107 having a unique single lift fork 112 specifically designed to pick up and locate the dies 52 within the press 20. The truck 107 also includes truck guides 114 that couple with frame guides 56 (see FIG. 1) attached to the frame 22 (FIG. 1). When the frame guides 56 and truck guides 114 act in concert, the truck 107 is placed in the proper position left-to-right and fore-to-aft.

The truck 107 also includes fork height indicators 116. The indicators 116 visually communicate the height of the fork 112 relative to an acceptable die load and unload height range. The operator lifts the fork 112 until the top of a back plate 118 is within the proper height range for the operation being preformed, either loading or unloading the die. Once the proper height is attained, the truck 107 can be aligned with the frame 22 via the guides 56 and 114. The combination of guides 56 and 114, and height indicators 116 insure the proper placement and removal of the die 52 in the shortest time possible.

Figure 5:
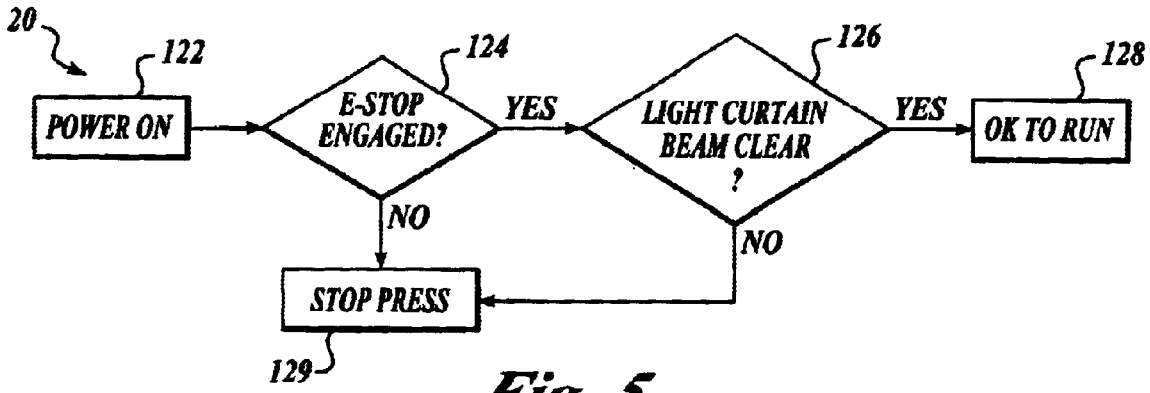
FIG. 5 is a flow chart of a power-on sequence.

FIG. 5 depicts a flow diagram 120 of a presently preferred power-on sequence and press operational safety features. Initially, the press 20 is turned to a power-on state as indicated by block 122. At this state the press control unit 60 has electrical power but the press 20 will not operate until two safety conditions are met. More specifically, block 124 assesses whether an emergency stop switch 72 is in the run or stop position. If the switch 72 is in the stop position the press 20 will not run, as indicated by block 110. Conversely, if the switch 72 is in the run position then a second safety condition is prompted. Block 126 indicates that the light curtain 106 is checked for interference, as discussed above. If the optical screen of the light curtain 106 is broken at any time during press 20 operation the press 20 will not operate as indicated by block 129. However, if the light curtain 106 is clear, as indicated by block 128, then the press 20 is ready to begin operation, either in automatic or manual mode.

Figure 6:
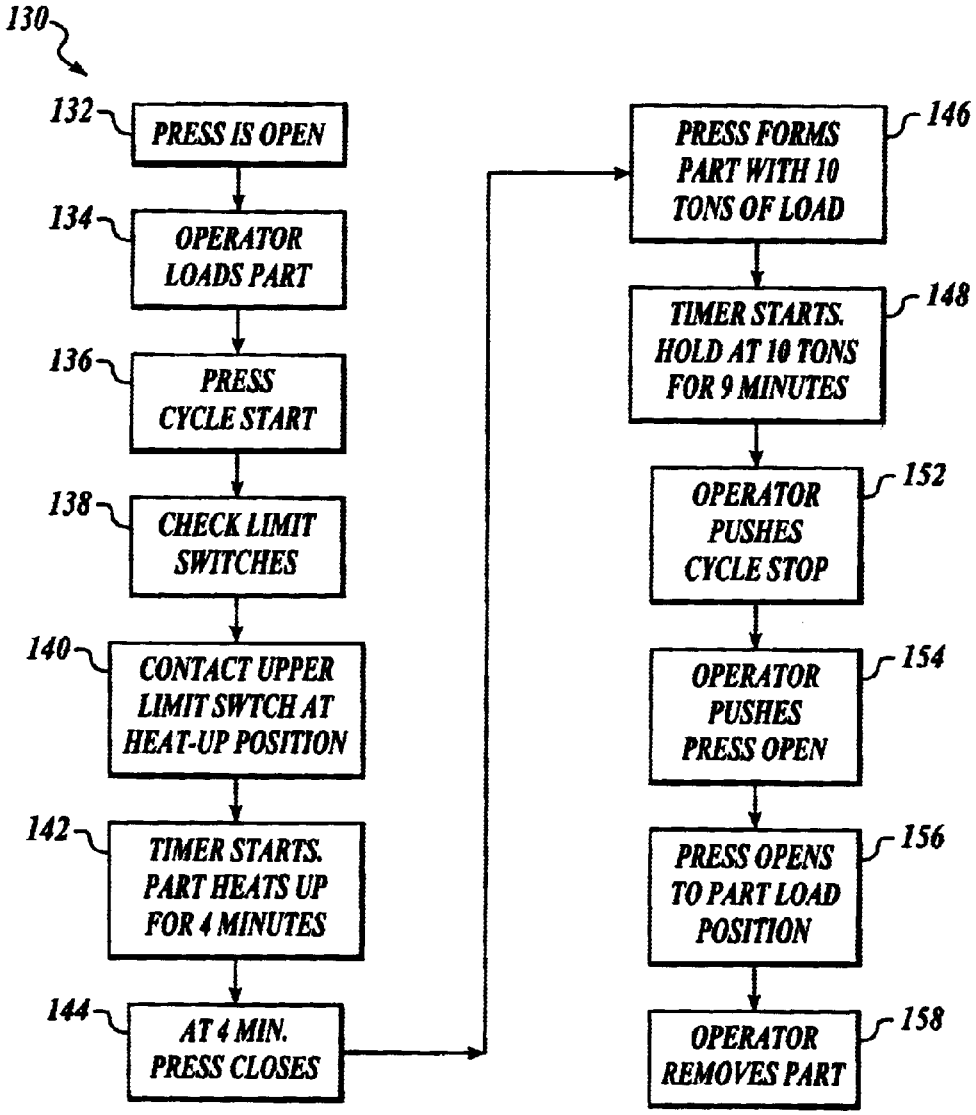
FIG. 6 is a flow chart of automatic press operation.

FIG. 6 depicts a one-button start up and run cycle 112. After the power-on cycle 100 discussed above is complete, the press 20 will now operate. Initially the press 20 is open as indicated by block 130. At block 134, the operator loads a part into the press via methods discussed above. At this point the one-button automatic cycle begins.

At a block 136, the automatic cycle 130 is initiated by activating the cycle start switch 74 (FIG. 3). At a block 138, the press 20 checks limit switches (not shown) attached to the press 20 for indication of any obstructions, such as an open door 53, to press operation. Subsequently, at a block 140, the press 20 partially closes to a pre-heat location. Once the press reaches the pre-heat location, at a block 142 a timer 70 begins and the part is heated for a predetermined amount of time. In a presently preferred embodiment, the pre-heat time is about four minutes and a heat temperature is about 1300 degree Fahrenheit. However, it will be appreciated that any length of time or any heating temperature is considered within the scope of this invention. After the pre-heat stage is complete at a block 144 the press 20 closes and loading begins.

Loading involves applying a predetermined load to the part being formed for a predetermined amount of time at a block 146. In a presently preferred embodiment, a load of about ten tons is applied to the heated part for a period of about nine minutes at a block 148. However, it will be appreciated that any load value applied for any length of time is considered within the scope of this invention. After the predetermined amount of time has expired, at a block 150 an indicator, for example a horn or light, notifies the operator. Subsequently, the operator stops the cycle at a block 152 by pressing the stop cycle switch 76. The operator actuates the press open switch 96 at a block 154. The press 20 then opens to the part load position at a block 156. The operator removes the formed part at a block 158, thereby completing the cycle.

Figure 7:
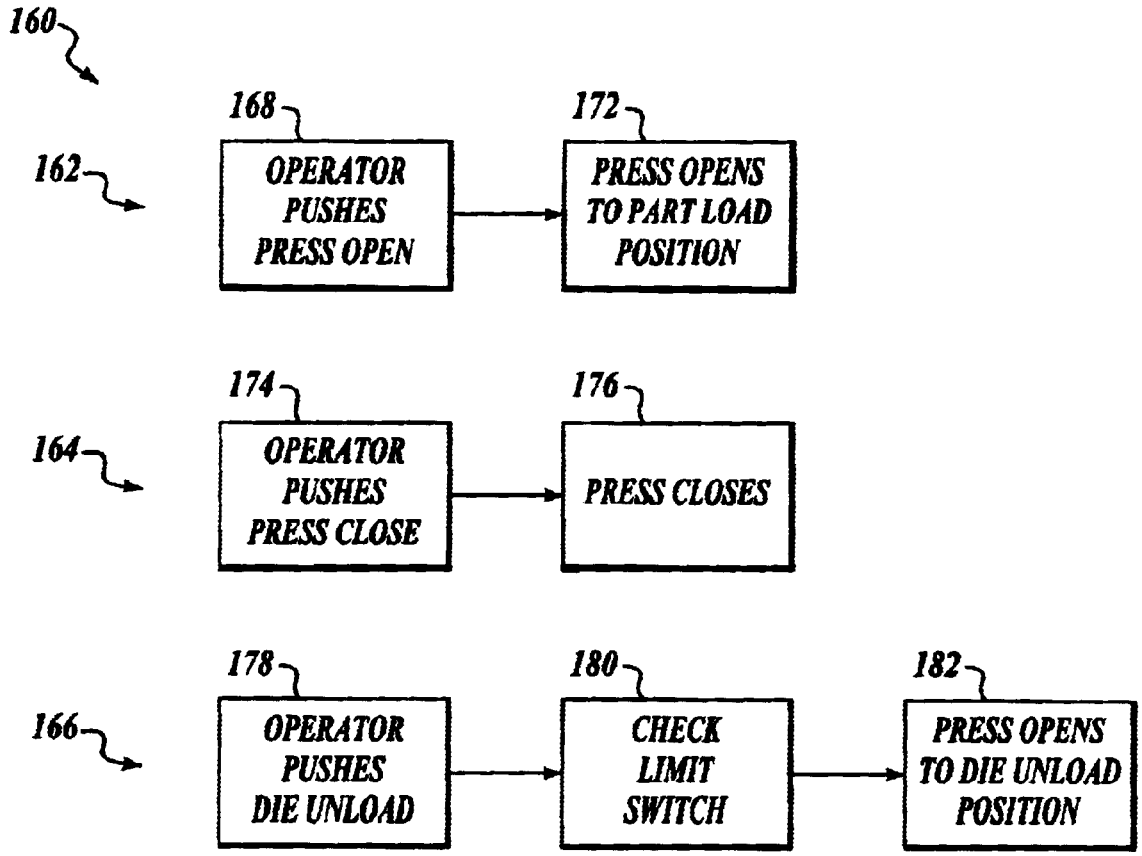
FIG. 7 is a flow chart of manual press operation.

FIG. 7 depicts a flow diagram of a presently preferred manual control of the press 20. Although the advantages of operating the press 20 in the automatic cycle mode 130 discussed above are many, there are times when manual press operation is desirable. Thus, three manual control modes 160 are included in this invention. The manual control modes 160 include an open mode 162, close mode 164, and a die unload mode 166. As discussed above, before any movement of the press 20 can occur, the power-on sequence 120 must meet the clear-to-run condition. Once the clear to run condition is met, the various manual modes 160 may be employed.

Manual operation is very simple. To manually open the press 20, the operator activates the press open switch 96 at a block 168. Upon actuation of the open switch 96, the press 20 will open to the part load position at a block 172. In a similar fashion, to manually close the press, the operator actuates the press close switch 94 at a block 174, and the press will close at a block 176. An operator can change dies 52 manually by activating the die unload switch 98 at a block 178. Upon activation of the die unload switch 98, the press 20 checks various limit switches (not shown) for indication of a clear unload travel path at a block 180. When the travel path is clear, the press 20 opens to a die unload position at a block 182, wherein the die is fully supported on the pins 44.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A compact hot press, comprising:

a frame;

a press unit attached to the frame, the press unit having a crown plate toward a top of the press unit, a base plate toward a bottom of the press unit, and a bolster plate intermediate the crown plate and the base plate, the bolster plate defining at least one aperture, the press unit having an upper press unit attached to the crown plate, the upper press unit being configured to receive an upper platen, the press unit having a lower press unit attached to the bolster plate, the lower press unit being configured to receive a lower platen, and the lower press unit being configured to contact the upper press unit when the press is closed such that the upper and lower platens are brought together to form a cavity between the upper platen and the lower platen, the cavity being arranged to receive a die therein, the press unit having a periphery;

a heating unit attached to the frame, the heating unit being configured to heat the upper platen and the lower platen;

a hydraulic unit attached to the frame and being attached to the press, the hydraulic unit being configured to move the bolster plate relative to the upper platen and the lower platen to a first position where the upper platen and lower platen are engaged at a pressure to a second position such that loading or unloading of the die is facilitated;

a control unit attached to the frame, the control unit being configured to monitor the temperature of the upper platen and the lower platen, to monitor the pressure, and to control the heating unit and the hydraulic unit responsive to the monitored temperature, the monitored pressure, and to time; and, a plurality of pins attached to the base plate, the pins being configured to pass through the aperture in a manner to separate the die from the lower press unit when the press is in a die unload position.

2. The press of claim 1, wherein the upper press unit further includes a first ceramic block adjacent the upper platen and the lower press unit further comprises a second ceramic block adjacent the lower platen, the first and second ceramic blocks being load carrying members.

3. The press of claim 2, wherein the upper press unit and the lower press unit further include insulation surrounding the upper platen and the lower platen, respectively.

4. The press of claim 3, wherein the insulation surrounding the upper press unit and the lower press unit surrounds the first and second ceramic blocks, respectively.

5. The press of claim 1, further comprising a bulb seal disposed between the upper press unit and the lower press unit.

6. The press of claim 1, further comprising a removable die key configured to connect the upper platen with an upper die section.

7. The press of claim 1, further comprising frame guides attached to the frame for aligning a die loading truck with the press to facilitate loading and unloading of the die.

8. The press of claim 1, wherein the control unit further comprises a tool temperature chart recorder arranged to monitor the temperature of the die.

9. The press of claim 1, further comprising at least one light curtain, the light curtain being configured to surround the press unit at its periphery and being in communication with the control unit arranged to stop press function if the light curtain is interrupted.

10. The press of claim 1, the hydraulic unit being further configured to move the bolster plate relative to the upper platen and the lower platen to a third position intermediate the first position and the second position, where the upper platen and lower platen are engaged without a significant pressure, and the control unit being further configured to control movement of the bolster plate unit to the third position to allow the die and a tool attached thereto to reach a predetermined temperature before controlling movement of the bolster plate to the second position.

11. The press of claim 1, wherein the pins further comprise four pins equally spaced around a center of the base plate.

12. The press of claim 1, wherein the hydraulic unit is an up acting hydraulic press.

13. The press of claim 1, wherein the heating unit is capable of heating the die to at least about 1300 degrees Fahrenheit.

14. The press of claim 1, wherein the hydraulic unit is capable of supplying a compressive load to the die.

* * * * *